US006817884B1

(12) United States Patent
Chen et al.

(10) Patent No.: US 6,817,884 B1
(45) Date of Patent: Nov. 16, 2004

(54) MULTI-I/O-PORT-41-CHANNEL CONNECTOR

(76) Inventors: Mao-Hsiung Chen, 3F, No. 11, Lane 60, Lee-Min Road, Hsin-Tien City, Taipei Hsien (TW); Kim Chen, No. 350, Ming-Te 1 Rd., Alley 16, Yung-An Li, Chu-Tu Dist., KeeLung City (TW)

( * ) Notice: Subject to any disclaimer, the term of this patent is extended or adjusted under 35 U.S.C. 154(b) by 0 days.

(21) Appl. No.: 10/629,627

(22) Filed: Jul. 30, 2003

(51) Int. Cl.[7] ..... H01R 13/627

(52) U.S. Cl. ..... 439/358; 439/350

(58) Field of Search ..... 439/358, 357, 439/352–354, 350, 578, 607–610, 362, 363, 901, 905

(56) References Cited

U.S. PATENT DOCUMENTS

| | | | | | |
|---|---|---|---|---|---|
| 4,854,895 | A | * | 8/1989 | Komatsu | 439/610 |
| D306,011 | S | * | 2/1990 | Komatsu | D13/147 |
| D324,846 | S | * | 3/1992 | Shibano | D13/147 |
| D325,191 | S | * | 4/1992 | Shibano | D13/147 |
| 6,139,350 | A | * | 10/2000 | Mathesius | 439/357 |
| 6,450,835 | B1 | * | 9/2002 | Lee | 439/607 |
| 6,520,809 | B1 | * | 2/2003 | Son | 439/679 |
| 6,579,114 | B2 | * | 6/2003 | Lord | 439/358 |

* cited by examiner

*Primary Examiner*—Alexander Gilman
(74) *Attorney, Agent, or Firm*—Bacon & Thomas PLLC

(57) ABSTRACT

A multi-I/O-port-41-channel connector includes first and second connectors, in which associated connecting pins and plugholes as well as a fastening device is available to thereby prevent any possible faulty connection and provide a convenient operation for enhanced fastening or detaching of the connectors.

3 Claims, 6 Drawing Sheets

MULTI-I/O-PORT-41-CHANNEL CONNECTOR

BACKGROUND OF THE INVENTION

1. Field of the Invention

The present invention relates to a multi-I/O-port-41-channel connector, which forms a buckle device and cooperative connecting pins and holes through paired male/female couplings for preventing faulty connection and providing easy operation for fastening or detaching of the connector.

2. The Prior Arts

A generic connector is formed by jointing a male coupling with a female coupling together for transmitting signals or data between two electronic devices, in which there is a most important connecting and fixing structure of male/female coupling in addition to a lead-wire connecting structure. A major of such a connecting and fixing structure of male/female coupling is fast connection/disconnection and connection strength resisting undesired separation.

SUMMARY OF THE INVENTION

It seems to be a usual way so far to joint and fix connectors by locking with bolts or fastening devices, in which the bolt is strong enough to build a reliable connection but weak in operability, while the fastening device is good for operation but weak in strength and it is particularly unsuitable to a 41-channel connector, after all, they are defective in one way or another.

Therefore, a primary object of the present invention is to provide an improved structure of multi-I/O-port-41-channel connector for eliminating foregoing defects.

In order to realize the above object, an improved structure of multi-I/O-port-41-channel connector of the present invention is comprised of a first connector and a second connector.

The first connector has a front end extended forwards to form a female coupling, in which a central portion of a front edge at its top end is dug away to form a mortise, and a plurality of plugholes is provided with respective lead wires for signal transmission. The second connector also has a front end extended forwards to form a male coupling, in which a plurality of lead wires for signal transmission is provided and extended outwardly to form a plurality of connecting pins. The plugholes and the connecting pins arranged in respective couplings are zigzag correspondent. When the first connector is to be butt-jointed with the second connector, a tenon of an extension arm in the second connector is engaged with the mortise in the first connector through a stroke of depression onto a pushbutton of the extension arm to hence joint or detach the connectors.

The merits of the multi-I/O-port-41-channel connector of the present invention may be summarized as the following:

(1) It is possible to prevent faulty connection by means of a fastening device and the corresponding plugholes and connecting pins.

(2) The fastening device is particularly good in fastening and detaching operability as well as connection quality.

(3) To simplify the fabrication process and accordingly lower the fabrication cost is possible.

For more detailed information regarding advantages or features of the present invention, at least an example of preferred embodiment will be described below with reference to the annexed drawings.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

Figure 1:
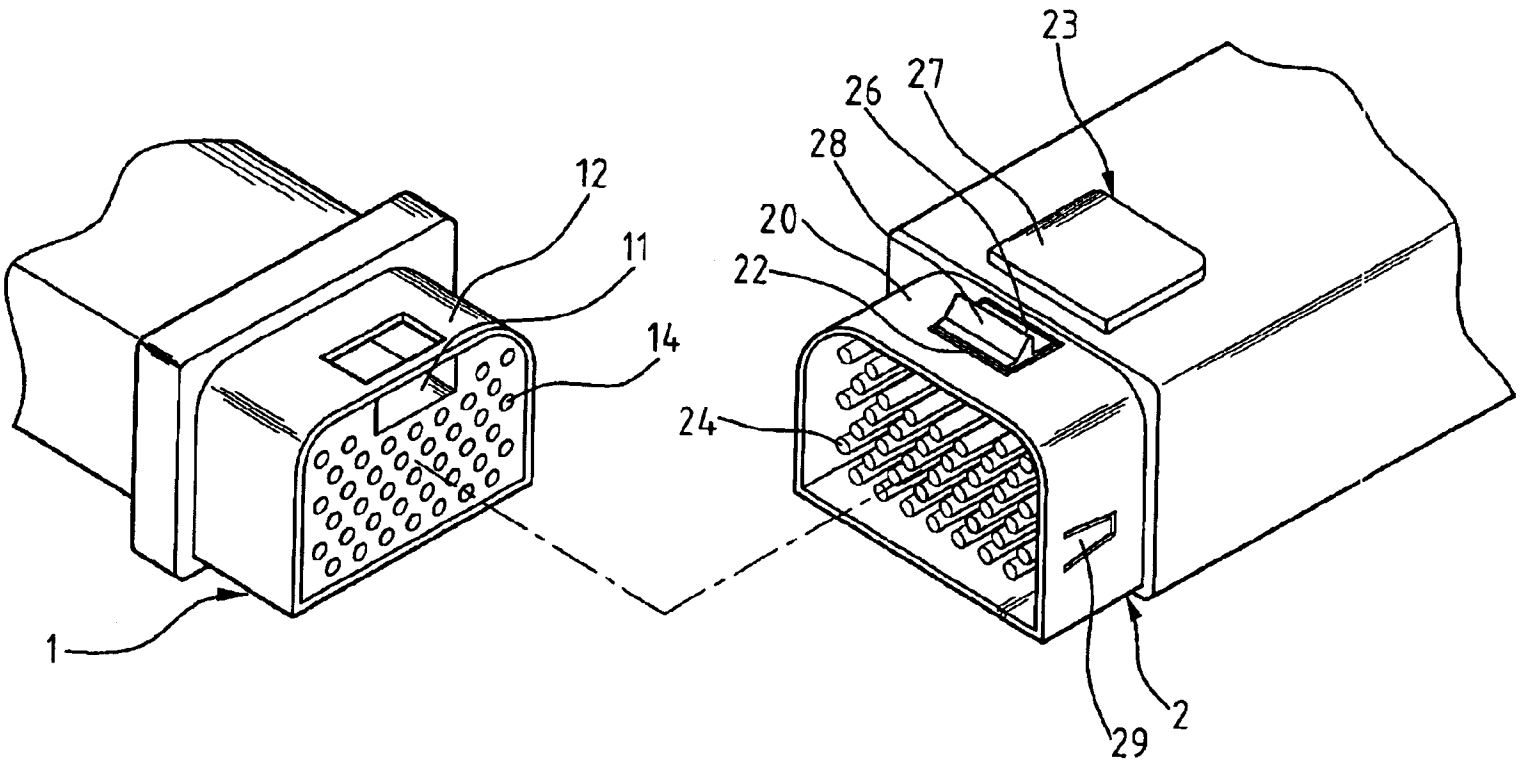
FIG. 1 is a perspective view of a multi-I/O-port-41-channel connector constructed in accordance with the present invention with first and second connectors separated from each other.
Figure 2:
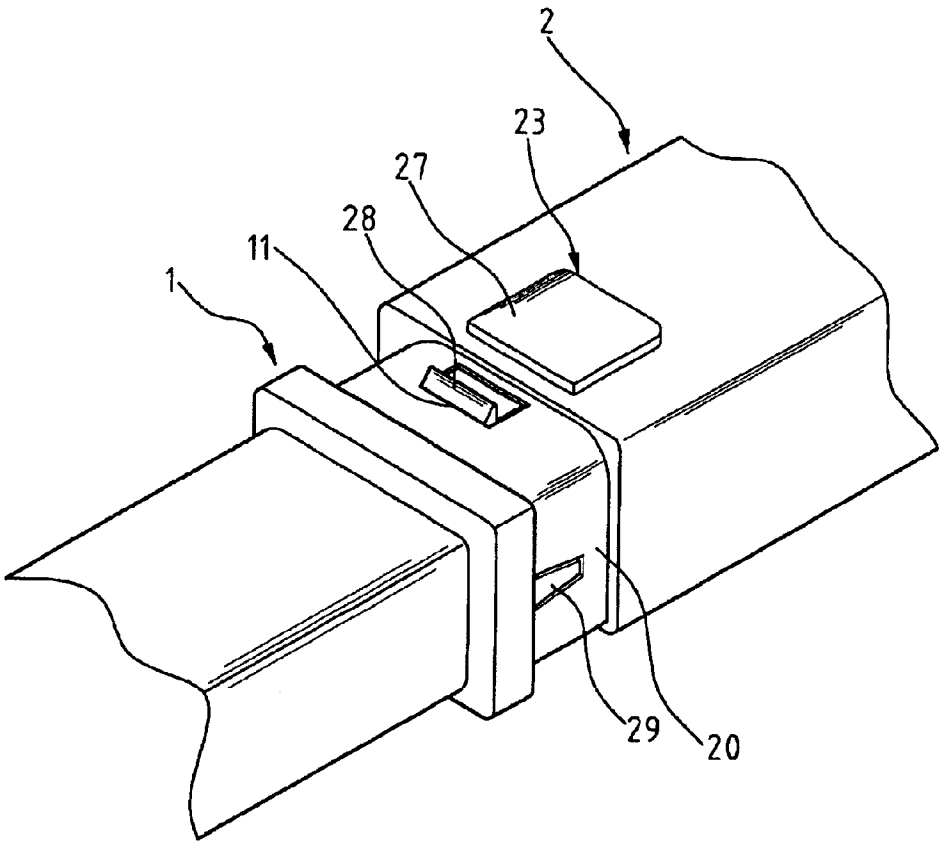
FIG. 2 is a perspective view of the multi-I/O-port-41-channel connector of the present invention with the first and second connectors mating each other.
Figure 3:
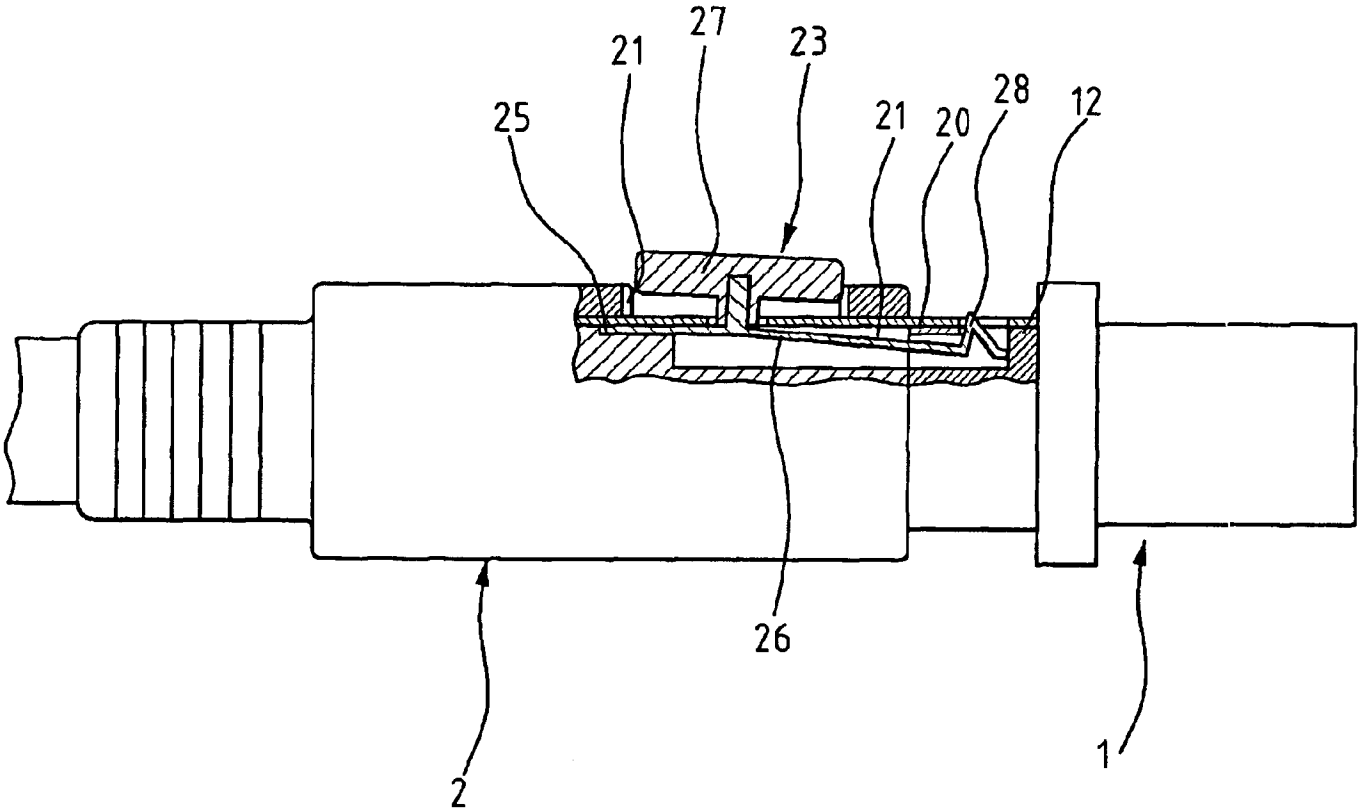
FIG. 3 shows a side elevational view, partially cutaway, of the multi-I/O-port-41-channel connector of the present invention before a fastener element is snap-retained.
Figure 4:
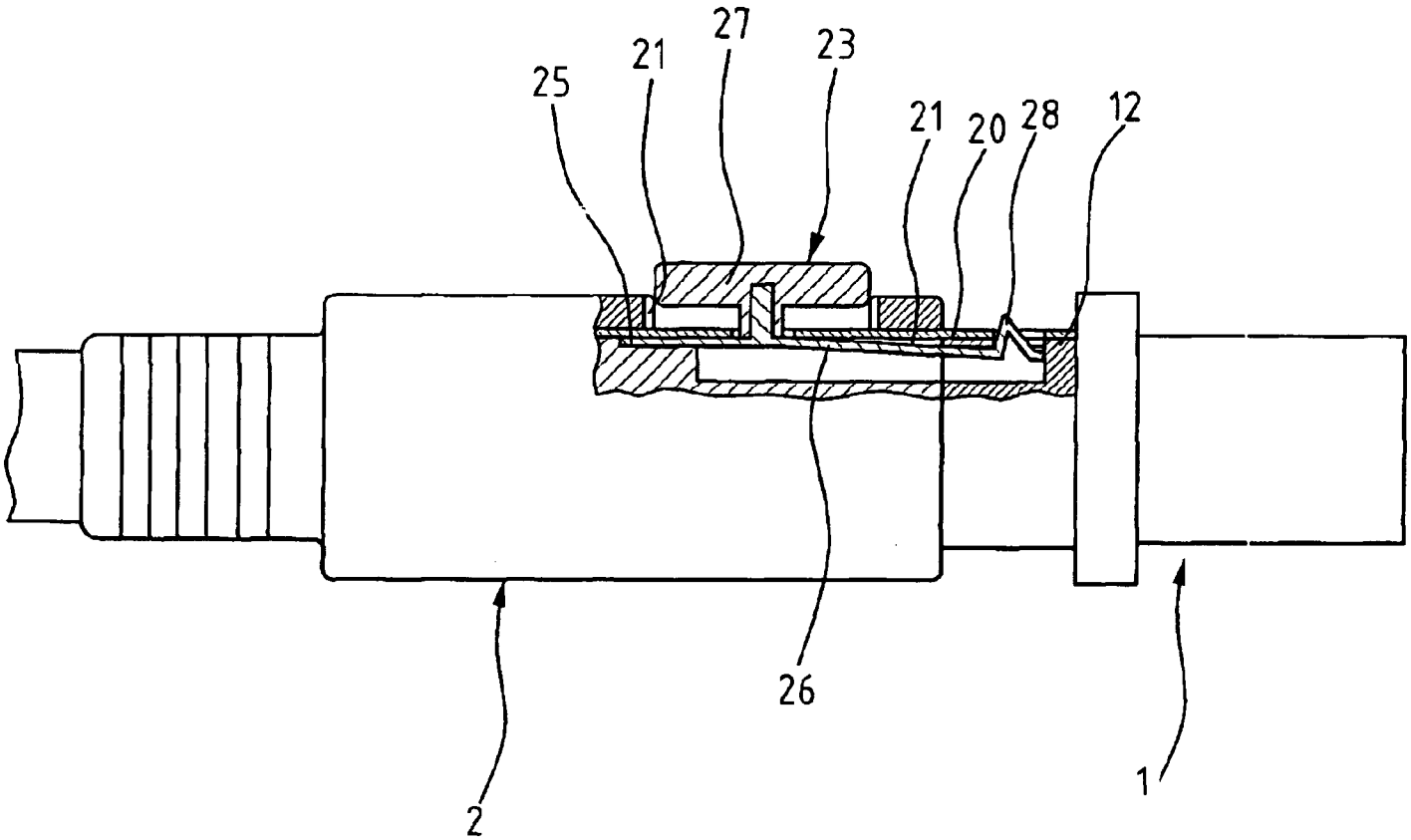
FIG. 4 is similar to FIG. 3 but showing the multi-I/O-port-41-channel connector of the present invention after the fastener element is snap-retained.

An embodiment of a multi-I/O-port-41-channel connector constructed in accordance with the present invention shown in the drawings, including FIGS. 1–4 comprises a first connector 1 and a second connector 2.

The first connector 1 has a front end extending forwards to form a female coupling 12, in which a central portion of a front edge at its top end is dug away to form a mortise 11, and a plurality of plugholes 14 is provided with respective lead wires for signal transmission. The second connector 2 has a front end extending forwards to form a male coupling 20, in which a plurality of lead wires for signal transmission is provided and extending outwardly to form a plurality of connecting pins 24.

The outer fringe of the female coupling 12 in the first connector 1 and the corresponding inner fringe in the mouth of the male coupling 20 of the second connector 2 are designed to form a tight sleeve-joint mechanism.

At the top end of the male coupling 20 of the second connector 2, a recess extends forwards to form a receptacle 21 and a through hole 22 for accommodating a fastening device 23. In the fastening device 23, a fixing portion 25 at one end is fixed in the receptacle 21 and extended outwardly to reach the inner space of the male coupling 20 and form a resilient extension arm 26. A pushbutton 27 is fixedly disposed on the top end of the extension arm 26, and the fore end of the extension arm 26 is located right under the through hole 22 and is extended upwardly to form a wedge-style tenon 28 with an outward slope. When the pushbutton 27 is depressed, the extension arm 26 is supposed to bend downwardly to sink the tenon 28 under the through hole 22.

When the first connector 1 is butt-jointed with the second connector 2, the tenon 28 is engaged with the mortise 11. For more details, reference is made to FIGS. 3 and 4. When jointing the first and the second connector 1, 2 together, the tenon 28 of the second connector 2 is at the very beginning forced down by an upper transom of the mortise 11 of the first connector 1 to lower down the front end of the extension arm 26 of the fastening device 23 accordingly until the tenon 28 enters the mortise 11 to have these two connectors jointed.

For detaching the connectors 1, 2 from each other, the pushbutton 27 of the fastening device 23 is depressed and the front end of the extension arm 26 is bent downwardly to descend the tenon 28 to escape from the mortise 11, thus the connectors are detached accordingly.

Moreover, a plurality of spring leaves 29 is fixedly disposed on the inner wall of the male coupling 20 for tightening the connection of the couplings 12, 20.

Figure 5:
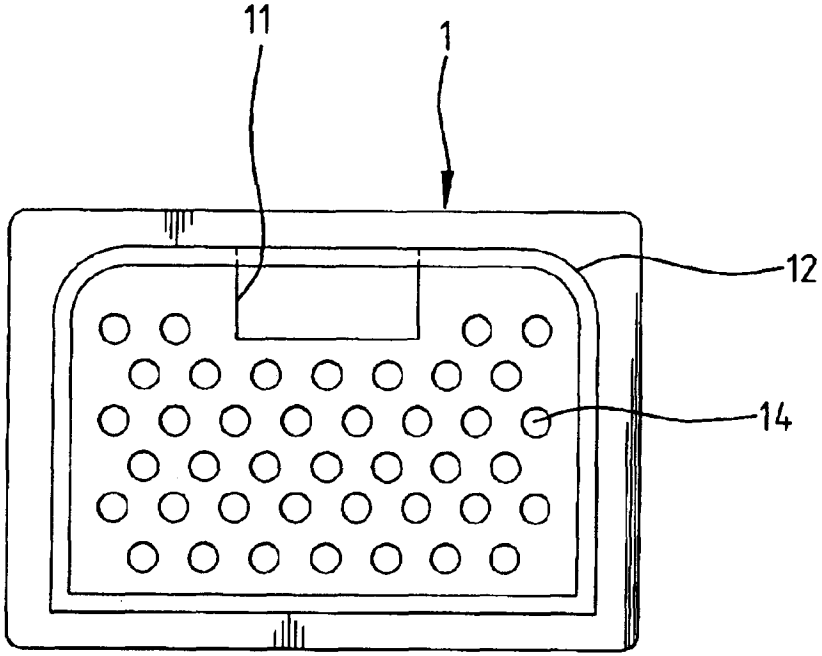
FIG. 5 is a front view of the first connector of the multi-I/O-port-41-channel connector of the present invention.
Figure 6:
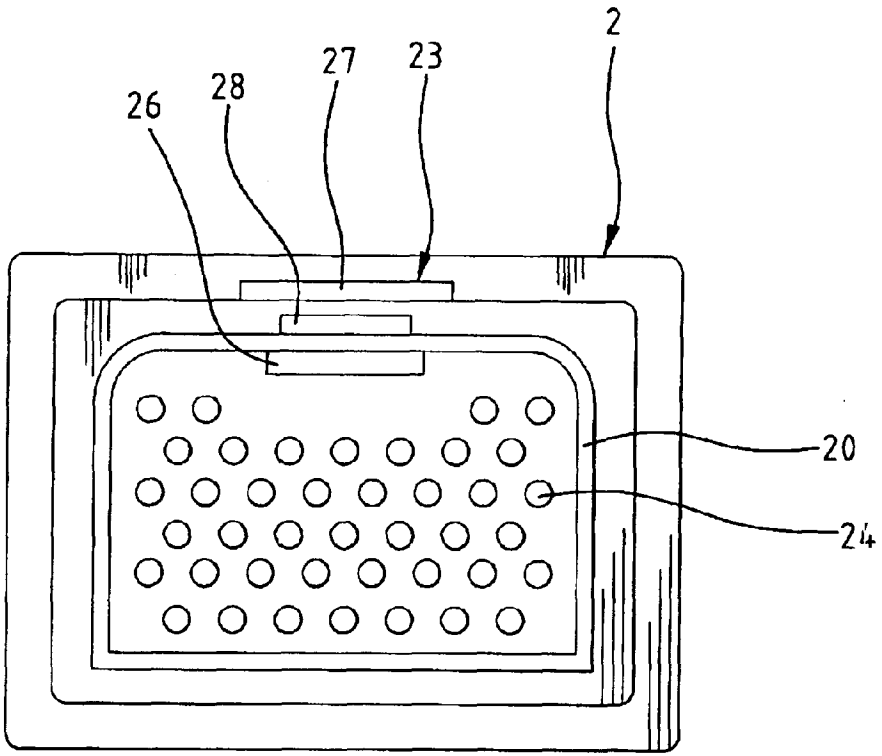
FIG. 6 is a front view of the second connector of the multi-I/O-port-41-channel connector of the present invention.

The plugholes 14 and the connecting pins 24 are aligned in respective arrays with corresponding zigzag rows on one-hole-to-one-pin basis (as shown in FIG. 5 and 6). In this case, both the amount of the plughole 14 and the connecting pin 24 are 41.

Finally, one point to be mentioned is a function for preventing faulty connection. That is, any incorrect connection of the connectors 1, 2 is prohibited in order not to damage the plugholes 14 or the connecting pins 24 according to the present invention.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A multi-I/O-port-41-channel connector comprising:

a first connector having a front end extending forwards to form a female coupling, in which a central portion of a front edge at a top end of the female coupling is dug away to form a mortise, and a plurality of plugholes is provided with respective lead wires for signal transmission; and a second connector having a front end extending forwards to form a male coupling, in which a plurality of lead wires for signal transmission is provided and extending outwardly to form a plurality of connecting pins;

where the plughole and the pin both have a number of forty one and are aligned zigzag in horizontal rows; the outer fringe of the female coupling in the first connector and the corresponding inner fringe in the mouth of the male coupling of the second connector forming a tight sleeve-joint mechanism, at the top end of the male coupling of the second connector, a recess extending forwards to form a receptacle and a through hole for accommodating a fastening device, in the fastening device, a fixing portion at one end is fixed in the receptacle and extending outwardly to reach the inner space of the male coupling and form a resilient extension arm; a pushbutton is fixedly disposed on the top end of the extension arm, and the fore end of the extension arm is located right under the through hole and extending upwardly to form a wedge-style tenon with an outward slope, when the pushbutton is depressed, the extension arm bent downwardly to sink the tenon under the through hole, and when these two connectors are butt-jointed, the tenon is engaged in the mortise.

2. The multi-I/O-port-41-channel connector according to claim 1, wherein the plugholes and connecting pins are aligned zigzag in horizontal rows in respective arrays on one-to-one basis.

3. The multi-I/O-port-41-channel connector according to claim 1, wherein a plurality of spring leaves is fixedly disposed on the inner wall of the male coupling for tightening the connection of the couplings.

* * * * *